US006930641B2

(12) United States Patent
Ohara et al.

(10) Patent No.: US 6,930,641 B2
(45) Date of Patent: Aug. 16, 2005

(54) ANTENNA AND RADIO DEVICE USING THE SAME

(75) Inventors: Masahiro Ohara, Katano (JP); Naoyuki Takagi, Joyo (JP); Susumu Inatsugu, Hirakata (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 130 days.

(21) Appl. No.: 10/297,429

(22) PCT Filed: Jun. 8, 2001

(86) PCT No.: PCT/JP01/04867

§ 371 (c)(1),
(2), (4) Date: May 6, 2003

(87) PCT Pub. No.: WO01/95433

PCT Pub. Date: Dec. 13, 2001

(65) Prior Publication Data

US 2003/0169209 A1 Sep. 11, 2003

(30) Foreign Application Priority Data

Jun. 8, 2000 (JP) ..... 2000-171535

(51) Int. Cl.[7] ..... H01Q 1/38; H01Q 1/24

(52) U.S. Cl. ..... 343/702; 343/700 MS; 343/895

(58) Field of Search ..... 343/702, 700 MS, 343/895, 846, 765, 853; 455/101; H01Q 1/38, 1/24

(56) References Cited

U.S. PATENT DOCUMENTS

| | | | | | |
|---|---|---|---|---|---|
| 5,585,807 | A | | 12/1996 | Takei | 343/702 |
| 5,966,097 | A | * | 10/1999 | Fukasawa et al. | 343/700 MS |
| 5,982,330 | A | * | 11/1999 | Koyanagi et al. | 343/702 |
| 6,147,652 | A | * | 11/2000 | Sekine | 343/702 |
| 6,295,462 | B1 | * | 9/2001 | Kudoh | 455/41.3 |
| 6,456,246 | B2 | * | 9/2002 | Saito | 343/702 |
| 6,563,476 | B1 | * | 5/2003 | Sheng-Gen et al. | 343/895 |
| 2002/0002037 | A1 | * | 1/2002 | Ito et al. | 455/101 |

FOREIGN PATENT DOCUMENTS

| | | | | |
|---|---|---|---|---|
| EP | 0 548 975 A1 | | 6/1993 | H01Q/1/24 |
| EP | 0 987 789 A1 | | 3/2000 | H01Q/9/42 |
| JP | 1-181305 | * | 7/1989 | H01Q/9/30 |
| JP | 5-251923 | | 9/1993 | H01Q/9/32 |
| JP | 8-204431 | | 8/1996 | H01Q/5/01 |
| JP | 10-229304 | | 8/1998 | H01Q/1/38 |
| JP | 11-154815 | | 6/1999 | H01Q/1/24 |
| JP | 11-308030 | | 11/1999 | H01Q/1/24 |
| JP | 2000-22431 | | 1/2000 | H01Q/9/26 |

OTHER PUBLICATIONS

"Radiation Characteristics of Shunt–Driven Inverted L–Type Antenna", J. Nagai et al.

* cited by examiner

*Primary Examiner*—Trinh Vo Dinh
(74) *Attorney, Agent, or Firm*—McDermott Will & Emery LLP

(57) ABSTRACT

An inverted-F type antenna and a wireless device using the same. The antenna element comprises a grounding conductor plate and a conductor at least a part of which is generally spiral in shape and is disposed above the grounding conductor plate apart from the grounding conductor plate. A stub connects one end of the antenna element with the grounding conductor plate. A feeding point locates on the antenna element at a predetermined distance from one end of the antenna element and a feeder line electrically connects the feeding point with an external circuit. The antenna element is secured on the grounding conductor plate with a support member made of a dielectric material.

21 Claims, 16 Drawing Sheets

ANTENNA AND RADIO DEVICE USING THE SAME

TECHNICAL FIELD

The present invention relates to antennas for installation in wireless devices such as for mobile communication and to wireless devices using the antennas.

BACKGROUND ART

In recent years, with the increasing demand for wireless devices for mobile communication, various communication systems have been developed, and a high performance, small, and light-weight wireless device that complies with a plurality of communication systems by an integrated unit is being desired to come out on the market. Accordingly, there is an inevitable demand for the development of antennas equipped in these wireless devices.

Typical example of a device for such mobile communication is the portable telephone system, which is widely used all over the world and the frequency band of which varies depending on the area. As an example, the frequency band used for digital portable telephone system is 810 to 960 MHz in Japan for Personal Digital Cellular 800 (PDC800) system, and in Europe and America, 890 to 960 MHz for Group Special Mobile Community (GSM) system, 1,710 to 1,880 MHz for Personal Communication Network (PCN) system, and 1,850 to 1,990 MHz for Personal Communication System (PCS). As far as the antennas built into the portable telephones conforming to these systems is concerned, planar inverted-F type antennas have been generally and widely used so far. A description will be given on a typical example of such antennas referring to FIG. 26 and FIG. 27.

FIG. 26 is a perspective view of a prior art antenna. FIG. 27 is a partially cut-away perspective view of the rear side of a portable telephone that incorporates the antenna. In FIG. 26, for example, grounding conductor plate 2 made of 0.2 mm thick copper alloy is disposed underneath and in parallel with antenna element 1 made of copper alloy plate having approximate dimensions of 35 mm×45 mm, and 0.2 mm thickness located at a distance of 9 mm from antenna element 1. As shown in FIG. 26, antenna element 1 is secured to grounding conductor plate 2 by means of a support member 1*a* made of a resin-based dielectric material such as ABS and PPO. First terminal 3 formed on one end of antenna element 1 is electrically connected with grounding conductor plate 2 by soldering and the like method. Antenna 7 is configured in a manner such that second terminal 5 is provided at feeding point 4 near first terminal 3 of antenna element 1 being protruded from grounding conductor plate 2 through hole 6 without any electrical contact with grounding conductor plate 2. On the other hand, as shown in FIG. 27, antenna 7 is disposed inside rear case 9 of portable telephone 8. Though not shown in FIG. 27, grounding conductor plate 2 of antenna 7 is electrically connected with a metal shielding section formed on the inside surface of rear case 9, and second terminal 5 of antenna 7 is electrically connected by press fit and the like method with a radio frequency circuit board disposed inside rear case 9 of portable telephone 8.

A description on the operation of antenna 7 described above and portable telephone 8 employing antenna 7 will now be given in the following.

First terminal 3 formed on antenna element 1 of antenna 7 is an inductive line while the other parts excluding the part of first terminal 3 of antenna element 1 as viewed from feeding point 4 forms a capacitive line. Side lengths L1, L2 of antenna element 1, width L3 of first terminal 3, and distance L4 between first terminal 3 and feeding point 4 are so determined that the input impedance of antenna 7 in a desired frequency band as viewed from feeding point 4 of antenna element 1 will give a desired value. The input impedance is determined by the position of feeding point 4, namely L3 and L4, and the impedance matching with the input/output impedance of 50Ω of the radio frequency circuit can be obtained in a desired frequency band. When transmitting or receiving with portable telephone 8, the signal power as transmitted or received in a desired frequency band by antenna element 1 is put out from or supplied to the radio frequency circuit placed in rear case 9 of portable telephone 8 through second terminal 5 formed on antenna element 1, respectively. Technical details of such a planar inverted-F type antenna are published in "New Antenna Engineering" (in Japanese), ISBN4-915449-80-7, pages 109–114, and many other technical papers and books. According to these literatures, the planar inverted-F type antenna is suitable as an antenna for portable telephones that require a small size, high gain, and wide directional radiation pattern. It gives an advantage of not only enabling relative downsizing and slimming for incorporation into the case of a device but also providing freedom of device design. There is also an advantage that, by built-in constitution of the antenna, the antenna is better protected from mechanical shocks than a non-built-in antenna, and the antenna will scarcely experience mechanical damage thereby lengthening life of the antenna.

However, the operating frequency band, being a key factor of electrical characteristics, of these prior art antennas has only a specific bandwidth of approximately 3% at the maximum. The only way to improve this is to enlarge the shape, which will make the antenna inappropriate for use as a small, thin, wide-band, and high sensitivity built-in type antenna that is demanded by the market. Also, even though wide bandwidth and high sensitivity are pursued at the expense of miniaturization, a complicated impedance matching circuit will be required between the antenna and the radio frequency circuit thus presenting an obstacle for price reduction of portable telephones.

SUMMARY OF THE INVENTION

The present invention addresses the problems discussed above, and aims to provide a built-in type antenna with a miniature size, wide bandwidth, high sensitivity, multi-band capability, and easy-to-match impedance and therefore a wireless device using the antenna with high productivity, low cost and good speech quality.

In order to achieve the above object, the antenna in accordance with the present invention comprises a grounding conductor plate, an antenna element consisting of a conductor at least a part of which is generally spiral in shape and disposed on the grounding conductor plate at a distance, a stub for electrically connecting an end portion of the antenna element with the grounding conductor plate, and a feeder line for electrically connecting a feeding point spaced apart from the end portion of the antenna element by a predetermined distance with an external circuit, where the antenna element is an inverted-F type antenna secured onto the grounding conductor plate by means of a support member made of a dielectric material.

The antenna in accordance with the present invention has many configurations as given in the following.

(1) At least a part of the antenna element disposed on a grounding conductor plate is a conductor that is generally meandrous in shape.

(2) At least a part of the antenna element disposed on a grounding conductor plate is a conductor that is generally spiral and generally meandrous in shape.

(3) At least a part of the stub of an antenna element, the antenna element, and the feeder line is a straight conductor.

(4) At least a part of the antenna element is a straight conductor.

(5) At least a parasitic antenna element is disposed in proximity to the antenna element.

(6) At least a part of the parasitic antenna element is configured with a conductor that is generally spiral in shape.

(7) At least a part of the parasitic antenna element is configured with a conductor that is generally meandrous in shape.

(8) At least a part of the parasitic antenna element is formed with a straight conductor.

(9) The antenna element is bent at a predetermined point on the antenna element.

(10) A branched antenna element is provided at a part of the antenna element other than the end portion.

(11) At least a part of the branched antenna element is configured with a conductor that is generally spiral or generally meandrous in shape.

(12) At least a part of at least one of the stub and the feeder line connected to the antenna element is configured with a conductor that is generally spiral or generally meandrous in shape.

(13) Two antenna elements that are fed in opposite phase can be provided.

(14) The grounding conductor plate and the grounding metal member of a wireless device can be shared.

According to the present invention, as the antenna element is a conductor that is generally spiral or generally meandrous in shape, the distance from one end of the antenna element to the feeding point and the thickness, length, pitch of the spiral and meanders can be easily determined, and therefore impedance matching corresponding to a desired frequency band can be obtained with ease, enabling to get a wider bandwidth, multi-band capability, and higher sensitivity required of an antenna. Also, as a generally spiral or generally meandrous conductor is used, a small and thin antenna with a simple structure and a high productivity can be obtained. Wireless devices using the antenna in each configuration described above and wireless devices equipped with two of the antennas for diversity communication are also covered by the present invention.

DETAILED DESCRIPTION OF THE PREFERRED EMBODIMENTS

Referring to FIGS. 1 to 25, descriptions will be given below on exemplary embodiments of the present invention.

Figure 1:
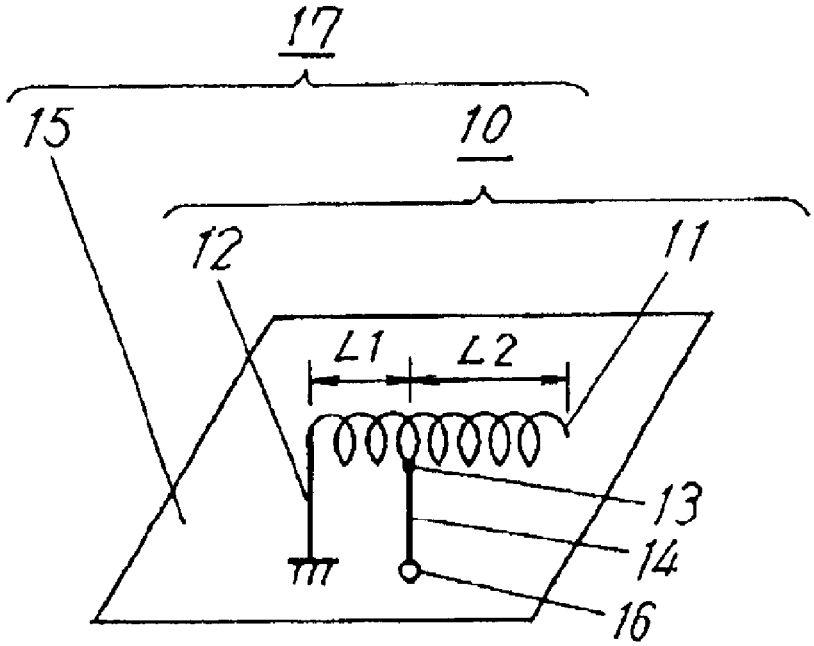
FIG. 1 is a diagram to illustrate an antenna configuration in Exemplary Embodiment 1 of the present invention.
Figure 26:
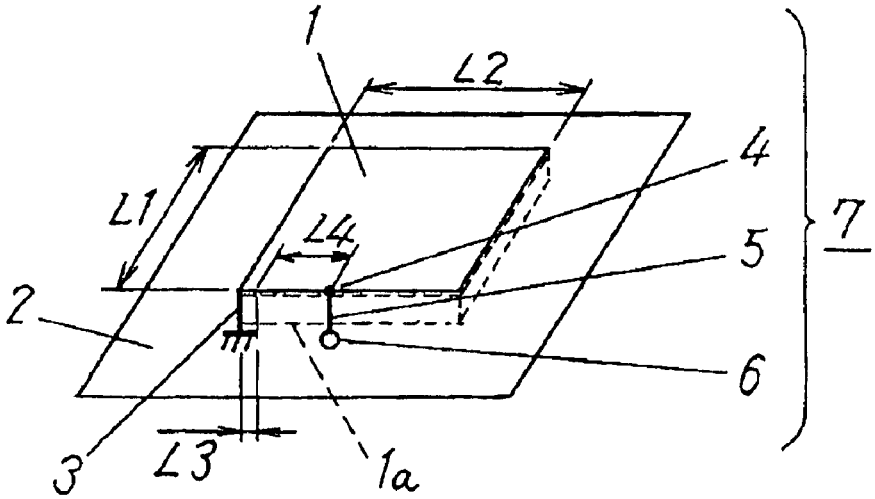
FIG. 26 PRIOR ART
FIG. 26 is a diagram to illustrate a configuration of a conventional antenna.
Figure 27:
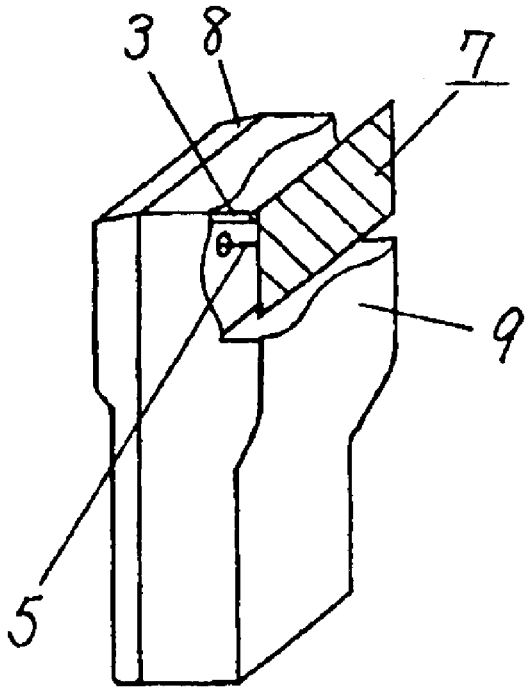
FIG. 27 PRIOR ART
FIG. 27 is a perspective view of a portable telephone incorporating a conventional antenna with the rear side of the portable telephone cut away.

Exemplary Embodiment 1:

FIG. 1 illustrates an antenna configuration in Exemplary Embodiment 1 of the present invention. In FIG. 1, antenna element 11 is an element made by forming into a spiral (hereinafter referred to as spiral element or spiral element section) a ribbon or wire of a conductor made of a conductive metal such as copper, copper alloy, aluminum alloy, or stainless steel alloy, or one of these metals plated with a conductive metal such as Au or Ni. Antenna element 11 has an electric length corresponding to a desired frequency band. One end of spiral element 11 is left open and the other end is grounded to grounding conductor plate 15 through stub 12. Feeding point 13 in proximity to stub 12 is connected to feeder line 14. Grounding conductor plate 15 is disposed in a manner such that it is in parallel with the central axis of the spiral of antenna element 11 keeping a predetermined spacing. Spiral element 11 is secured on grounding conductor plate 15 by a support member (not shown in FIG. 1, but see FIG. 26) formed by insert molding and the like method using a resin material having a predetermined dielectric constant and a low dielectric loss. It is shown in FIG. 1 that antenna main section 10 comprises spiral element 11, stub 12, and feeder line 14 (antenna components excluding grounding conductor plate 15 constitute antenna main section 10).

Stub 12 is electrically connected with grounding conductor plate 15 by soldering, crimping, or press fitting. Feeding point 13 is set at a position at which spiral element 11 functions properly in a desired frequency band. Feeder line 14 passes through hole 16 provided on grounding conductor plate 15 so that it will not make electrical contact with grounding conductor plate 15. Though not shown in FIG. 1, grounding conductor plate 15 is electrically connected with a grounding conductor plate or ground line provided on a portable telephone by such method as crimping. Feeder line 14 is also electrically connected with an input or output terminal of the portable telephone by such method as crimping.

A description will now be given on the operation of antenna 17 that has been configured as described above.

Antenna 17 consisting of antenna main section 10 and grounding conductor plate 15 with hole 16 has the same construction as an antenna generally called inverted-F type antenna. Length L1 from stub 12 to feeding point 13, and length L2 from feeding point 13 to the open end are so determined that a desired impedance characteristic could be obtained in the desired operating frequency band. The input impedance of antenna 17 depends on the position of feeding point 13 and, by properly selecting the position, it can be approximately matched with the input or output impedance (50Ω) of the radio frequency circuit of the portable telephone in the desired operating frequency band. In this case, as the central axis of spiral element 11 and grounding conductor plate 15 are arranged in parallel with each other, an electrostatic capacitance is produced between spiral element 11 and grounding conductor plate 15. As a result, a capacitive reactance is added to the input impedance of antenna 17 making the operating frequency of antenna 17 high. However, an inductive reactance can be added by adjusting the position of feeding point 13 thereby to cancel the capacitive reactance and to match the input impedance to 50Ω. Also, it is obvious that the signal power that can be transmitted or received by this antenna in a desired frequency band is put out from or supplied to the radio frequency circuit of the portable telephone via feeder line 14, respectively.

According to this exemplary embodiment, as described above, setting of the distance between stub 12 and feeding point 13, and the thickness, length, spiral pitch of spiral element 11 can be made with ease and a desired impedance characteristic that corresponds to a desired frequency band can be obtained with ease. Accordingly, it is possible to achieve an antenna having wider band and higher sensitivity while downsizing.

By the way, the above-mentioned conductor sections of antenna 17 may be configured by various ways such as printing, sintering, laminating, and plating, and the support member may be formed with a combination of various resin-based dielectric materials.

Figure 2:
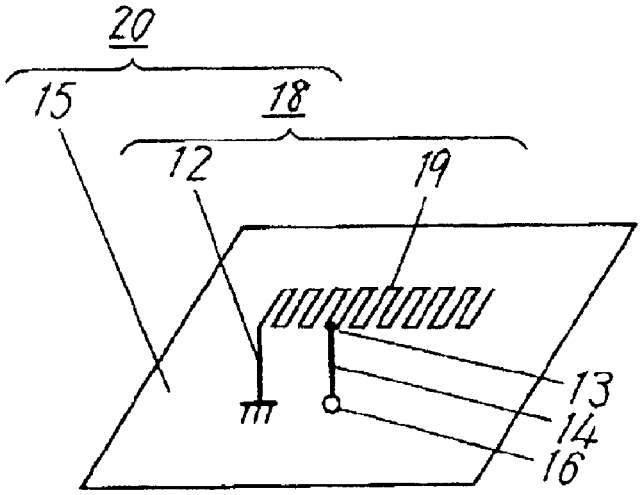
FIG. 2 is a diagram to illustrate an antenna configuration in Exemplary Embodiment 2 of the present invention.

Exemplary Embodiment 2:

FIG. 2 illustrates an antenna configuration in Exemplary Embodiment 2 of the present invention. In FIG. 2, antenna 20 is configured in the same way as in above-described Exemplary Embodiment 1 with the exception that antenna element 19 of antenna main section 18 is composed of an antenna element that is meandrous in shape (hereinafter also referred to as meandrous element or meandrous element section).

By employing this configuration, it is possible to easily obtain a desired impedance characteristic in a desired frequency band by adjusting the distance between stub 12 and feeding point 13, the line width, length, pitch, etc., of meandrous element 19. Accordingly, it is possible to achieve a wider bandwidth and higher sensitivity as well as downsizing of the antenna. Furthermore, by the use of an antenna element that is meandrous in shape rather than a spiral antenna element used in Exemplary Embodiment 1, further thinning of antenna is also enabled.

Figure 3:
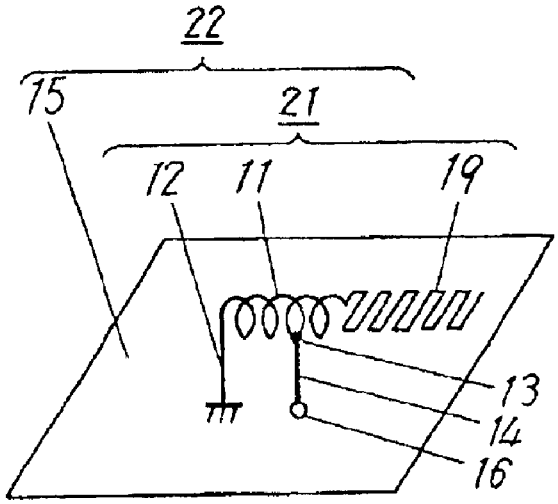
FIG. 3 is a diagram to illustrate an antenna configuration in Exemplary Embodiment 3 of the present invention.

Exemplary Embodiment 3:

FIG. 3 illustrates an antenna configuration in Exemplary Embodiment 3 of the present invention. In FIG. 3, antenna 22 is configured in the same way as in above-described Exemplary Embodiment 1 and Exemplary Embodiment 2 with the exception that antenna main section 21 is composed of spiral element section 11 and meandrous element section 19.

By employing this configuration, it is possible to easily make a fine-tuning to obtain a desired impedance characteristic in a desired frequency band by adjusting the distance between stub 12 and feeding point 13, and the line width, length, pitch, etc., of spiral element section 11 and meandrous element section 19. Accordingly, it is possible to obtain wider bandwidth and higher sensitivity of the antenna with a higher accuracy. In this Exemplary Embodiment 3, a further flexible downsizing and low-profile design of an antenna are enabled by forming antenna element 21 with the combination of spiral element section 11 and meandrous element section 19.

By the way, similar advantage can be obtained in this exemplary embodiment by exchanging the positions of the spiral element section and the meandrous element section.

Figure 4:
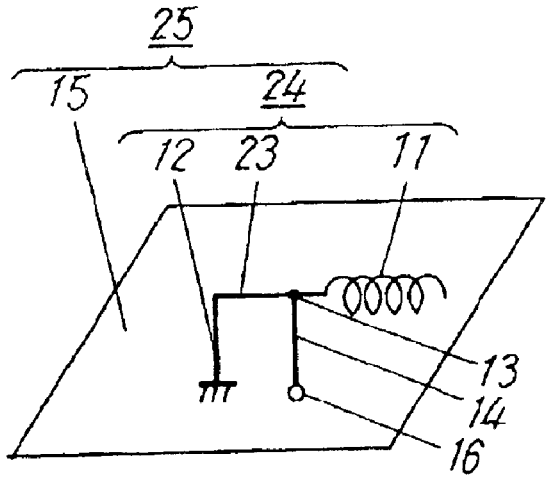
FIG. 4 is a diagram to illustrate an antenna configuration in Exemplary Embodiment 4 of the present invention.

Exemplary Embodiment 4:

FIG. 4 illustrates an antenna configuration in Exemplary Embodiment 4 of the present invention. In FIG. 4, antenna 25 is configured in the same way as in Exemplary Embodiment 1 with the exception that antenna main section 24 is composed of a straight conductor in between stub 12 and feeding point 13 of the antenna element.

By employing this configuration, the degree of freedom of design can be enhanced in addition to wider bandwidth, higher sensitivity, and downsizing capability of the antenna.

Figure 5:
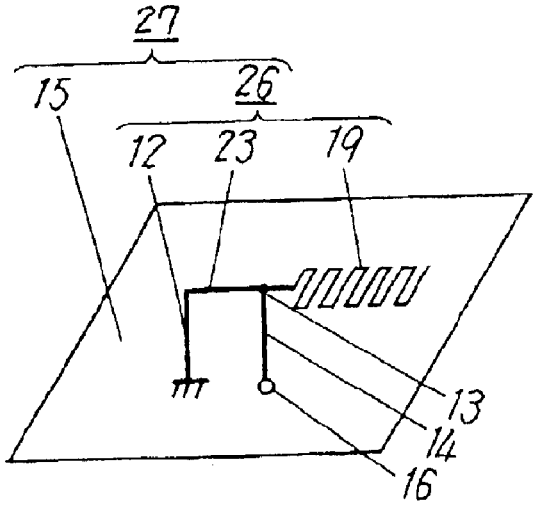
FIG. 5 is a diagram to illustrate an antenna configuration in Exemplary Embodiment 5 of the present invention.

Exemplary Embodiment 5:

FIG. 5 illustrates an antenna configuration in Exemplary Embodiment 5 of the present invention. In FIG. 5, antenna 27 is configured in the same way as in above-described Exemplary Embodiment 2 with the exception that antenna main section 26 is composed of a straight conductor in between stub 12 and feeding point 13. By employing this configuration, the degree of freedom for designing the antenna can be enhanced in addition to wider band, higher sensitivity, and downsizing capability of the antenna.

Figure 6:
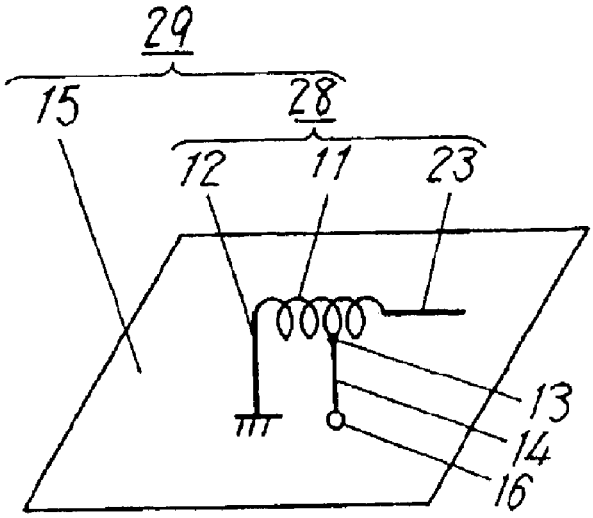
FIG. 6 is a diagram to illustrate an antenna configuration in Exemplary Embodiment 6 of the present invention.

Exemplary Embodiment 6:

FIG. 6 illustrates an antenna configuration in Exemplary Embodiment 6 of the present invention. In FIG. 6, antenna 29 is configured in the same way as in above-described Exemplary Embodiment 1 with the exception that antenna main section 28 uses a straight wire conductor as a part of the antenna element on the side of the open end.

By employing this configuration, the degree of freedom of design can be enhanced in addition to wider band, higher sensitivity, and downsizing capability of the antenna.

Figure 7:
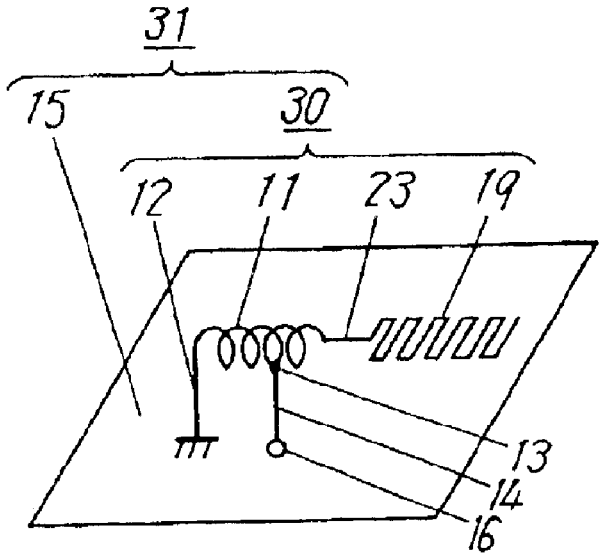
FIG. 7 is a diagram to illustrate an antenna configuration in Exemplary Embodiment 7 of the present invention.

Exemplary Embodiment 7:

FIG. 7 illustrates an antenna configuration in Exemplary Embodiment 7 of the present invention. In FIG. 7, antenna 31 is configured in the same way as in above-described Exemplary Embodiment 1 with the exception that antenna main section 30 uses an antenna element formed by connecting in sequence from the side of stub 12, spiral, straight, and meandrous antenna element sections.

By employing this configuration, the degree of freedom for design can be enhanced in addition to wider bandwidth, higher sensitivity, and downsizing capability of the antenna while being able to fine-tune the impedance characteristic.

Figure 8:
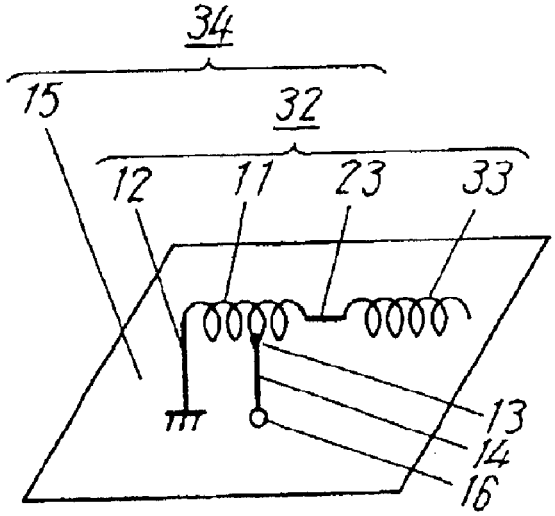
FIG. 8 is a diagram to illustrate an antenna configuration in Exemplary Embodiment 8 of the present invention.

Exemplary Embodiment 8:

FIG. 8 illustrates an antenna configuration in Exemplary Embodiment 8 of the present invention. In FIG. 8, antenna 34 is configured in the same way as in above-described Exemplary Embodiment 1 with the exception that antenna main section 32 uses an antenna element formed by connecting in sequence from the side of stub 12, spiral, straight, and spiral antenna element sections.

By employing this configuration, the degree of freedom of design can be enhanced in addition to wider bandwidth, higher sensitivity, and downsizing capability of the antenna while being able to fine-tune the impedance characteristic.

Figure 9:
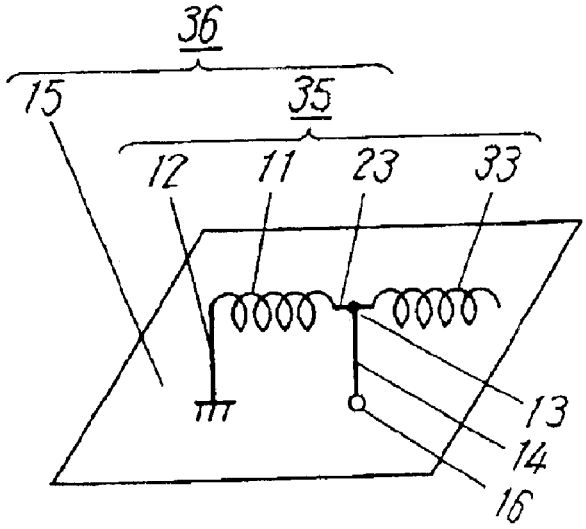
FIG. 9 is a diagram to illustrate an antenna configuration in Exemplary Embodiment 9 of the present invention.

Exemplary Embodiment 9:

FIG. 9 illustrates an antenna configuration in Exemplary Embodiment 9 of the present invention. In FIG. 9, antenna 36 is configured in the same way as in above-described Exemplary Embodiment 8 with the exception that feeding point 13 is provided on straight section 23.

By employing this configuration, the degree of freedom for design can be enhanced in addition to wider bandwidth, higher sensitivity, and downsizing capability of the antenna while being able to fine-tune the impedance characteristic.

Figure 10:
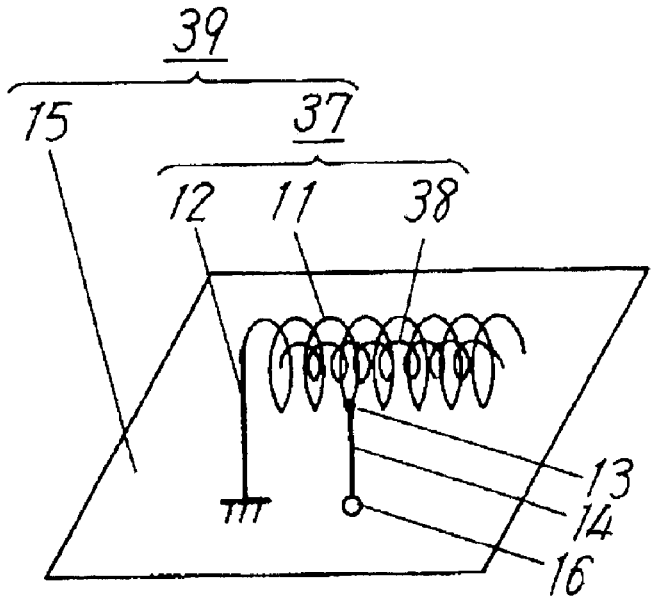
FIG. 10 is a diagram to illustrate an antenna configuration in Exemplary Embodiment 10 of the present invention.

Exemplary Embodiment 10:

FIG. 10 illustrates an antenna configuration in Exemplary Embodiment 10 of the present invention. In FIG. 10, antenna 39 is configured in the same way as in above-described Exemplary Embodiment 1 with the exception that antenna main section 37 is configured by disposing generally spiral parasitic antenna element 38 inside the spiral of antenna element 11.

By employing this configuration, as antenna element 11 and parasitic antenna element 38 are electromagnetically coupled, antenna 39 can be operated in at least two frequency bands.

Similar advantage can be obtained by forming parasiticantenna element 38 into a spiral having the same diameter as that of antenna element 11 and disposing it in such a manner that both antenna element 38 and 11 overlap or locate in proximity to the outer periphery of the spiral of antenna element 11. Also, though not shown in FIG. 10, the same advantage as above can be obtained by electrically connecting one end of parasitic antenna element 38 to grounding conductor plate 15 in addition to the above configuration and, at the same time, the impedance characteristic of parasitic antenna element 38 can be tuned with ease.

Figure 11:
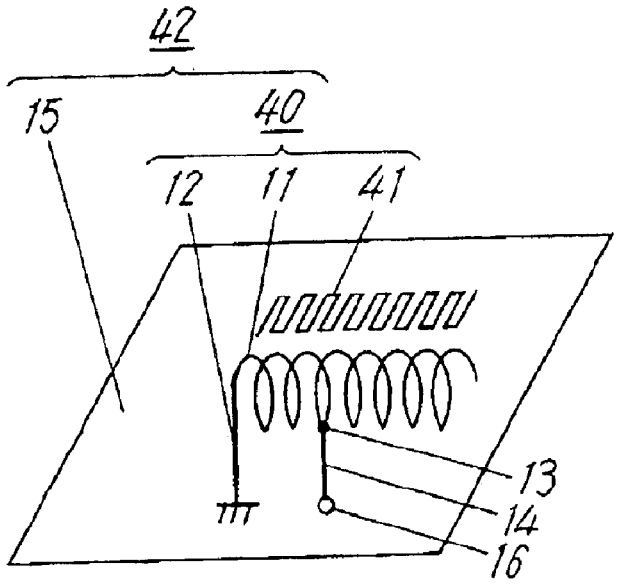
FIG. 11 is a diagram to illustrate an antenna configuration in Exemplary Embodiment 11 of the present invention.

Exemplary Embodiment 11:

FIG. 11 illustrates an antenna configuration in Exemplary Embodiment 11 of the present invention. In FIG. 11, antenna 42 is configured in the same way as in above-described Exemplary Embodiment 10 with the exception that antenna main section 40 is configured by disposing parasitic meandrous antenna element 41 in proximity to the outer peripheral of antenna element 11.

By employing this configuration, as antenna element 11 and parasitic meandrous element 41 are electromagnetically coupled, antenna 42 can be operated in at least two frequency bands.

Figure 12:
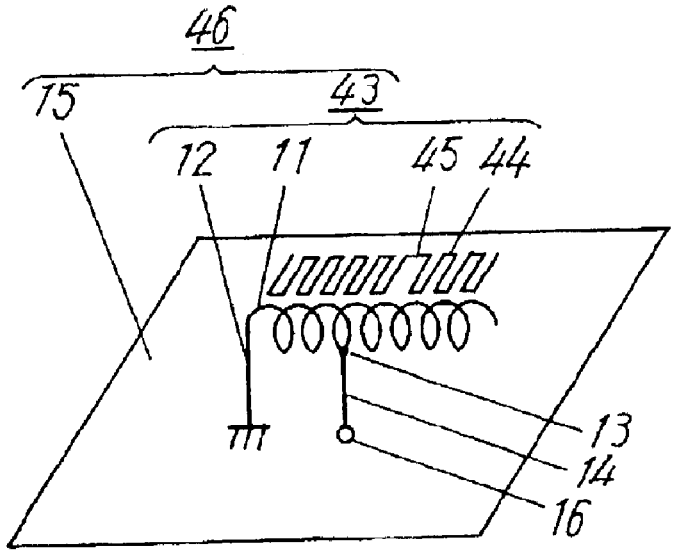
FIG. 12 is a diagram to illustrate an antenna configuration in Exemplary Embodiment 12 of the present invention.

Exemplary Embodiment 12:

FIG. 12 illustrates an antenna configuration in Exemplary Embodiment 12 of the present invention. In FIG. 12, antenna 46 is configured in the same way as in above-described Exemplary Embodiment 11 with the exception that antenna main section 43 is configured by forming straight section 45 on parasitic meandrous element 44 and disposing it in proximity to the outer periphery of antenna element 11.

By employing this configuration, as parasitic meandrous element 44 and antenna element 11 are electromagnetically coupled, antenna 46 can be operated in at least two frequency bands. Also, by adjusting the length of antenna element 11 and straight section 45, the impedance characteristic of antenna 46 can be tuned with ease.

Figure 13:
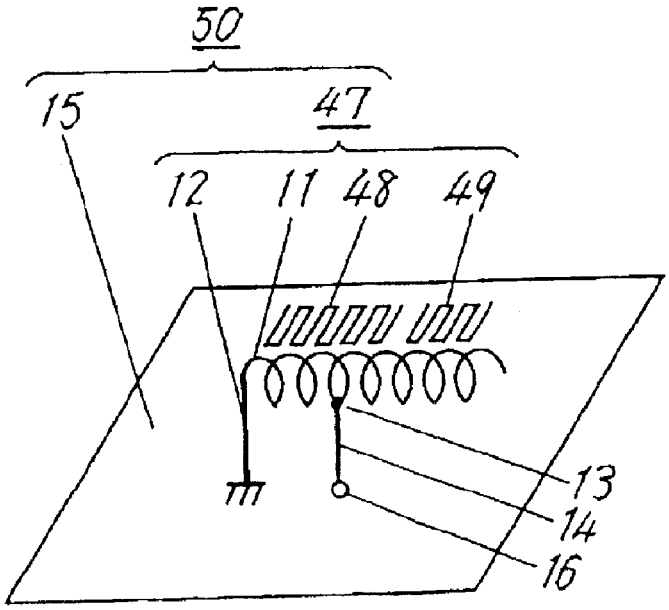
FIG. 13 is a diagram to illustrate an antenna configuration in Exemplary Embodiment 13 of the present invention.

Exemplary Embodiment 13:

FIG. 13 illustrates an antenna configuration in Exemplary Embodiment 13 of the present invention. In FIG. 13, antenna 50 is configured in the same way as in above-described Exemplary Embodiment 11 with the exception that antenna main section 47 is configured by forming parasitic meandrous elements 48 and 49 spaced apart from each other and disposing them in proximity to the outer periphery of antenna element 11.

By employing this configuration, as parasitic meandrous elements 48, 49 and antenna element 11 are electromagnetically coupled with each other, antenna 50 can be operated in at least two frequency bands. Also, by adjusting the length and position of parasitic meandrous elements 48 and 49, the impedance characteristic of antenna 50 can be tuned with ease.

Figure 14:
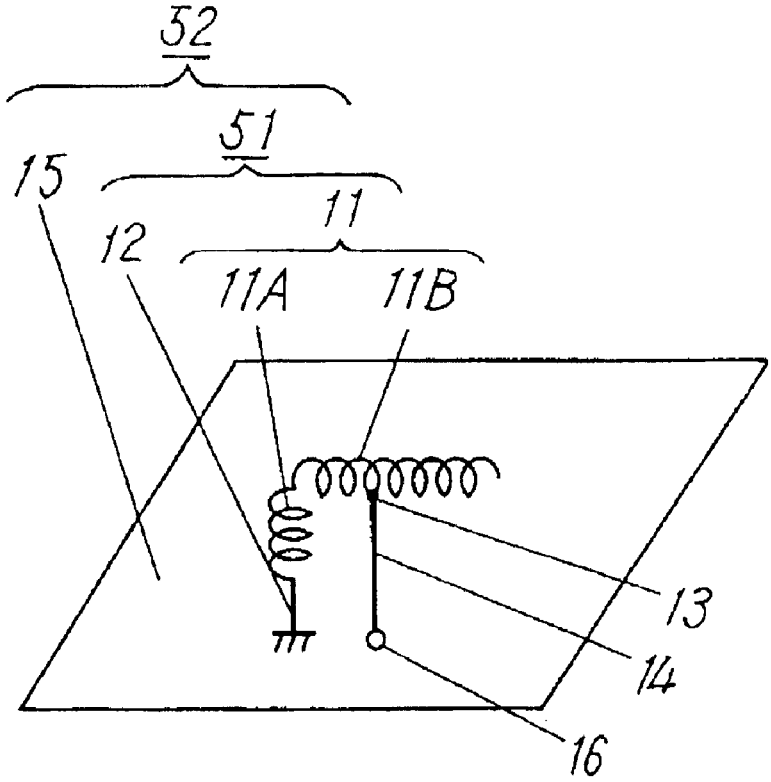
FIG. 14 is a diagram to illustrate an antenna configuration in Exemplary Embodiment 14 of the present invention.

Exemplary Embodiment 14:

FIG. 14 illustrates an antenna configuration in Exemplary Embodiment 14 of the present invention. In FIG. 14, antenna 52 is configured in the same way as in Exemplary Embodiment 1 with the exception that antenna main section 51 is configured by making an antenna element by bending single antenna element 11 to form bent section 11A and straight section 11B.

By employing this configuration, as an inductive reactance component of bent section 11A is loaded to stub 12 thereby controlling capacitive reactance component of stub 12, it is possible to enhance the degree of freedom for tuning the impedance characteristic of antenna 52. Also, as the polarization of the radiated waves from bent section 11A and straight section 11B are in orthogonal directions, this configuration provides an added advantage of improving the average effective antenna gain during actual use.

Figure 15:
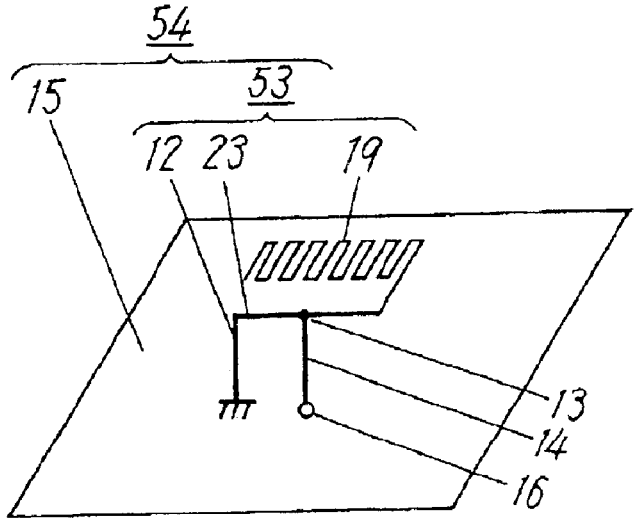
FIG. 15 is a diagram to illustrate an antenna configuration in Exemplary Embodiment 15 of the present invention.

Exemplary Embodiment 15:

FIG. 15 illustrates an antenna configuration in Exemplary Embodiment 15 of the present invention. In FIG. 15, antenna 54 is configured in the same way as in above-described Exemplary Embodiment 5 with the exception that antenna main section 53 is configured by bending the side end of feeding point 13 of the antenna element to form meandrous element section 19.

By employing this configuration, a reactance component is loaded to meandrous element section 19 thus enabling enhancement of the degree of freedom of tuning the impedance characteristic of antenna 54.

Figure 16:
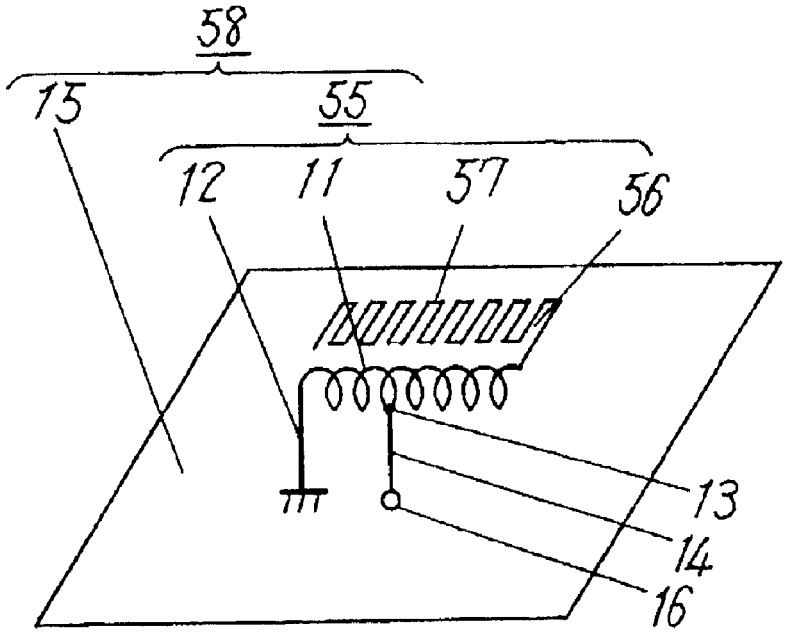
FIG. 16 is a diagram to illustrate an antenna configuration in Exemplary Embodiment 16 of the present invention.

Exemplary Embodiment 16:

FIG. 16 illustrates an antenna configuration in Exemplary Embodiment 16 of the present invention. In FIG. 16, antenna 58 is configured in the same way as in above-described Exemplary Embodiment 7 with the exception that antenna main section 55 is configured by electrically connecting straight section 56 to a side opposite stab 12 of antenna element 11 and further electrically connecting straight section 56 and one end of meandrous element section 57, and disposing meandrous element section 57 in proximity to the outer periphery of antenna element 11.

By employing this configuration, the degree of freedom for tuning the impedance characteristic of antenna 58 can be enhanced owing to electromagnetic coupling between antenna element 11 and meandrous element section 57 while being able to cope with a plurality of frequency bands.

Figure 17:
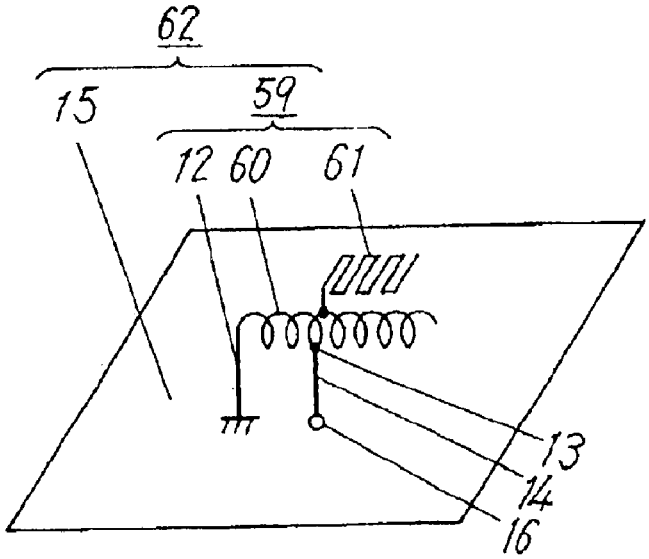
FIG. 17 is a diagram to illustrate an antenna configuration in Exemplary Embodiment 17 of the present invention.

Exemplary Embodiment 17:

FIG. 17 illustrates an antenna configuration in Exemplary Embodiment 17 of the present invention. In FIG. 17, antenna 62 is configured in the same way as in above-described Exemplary Embodiment 16 with the exception that antenna main section 59 is configured by electrically connecting branched meandrous element 61 to a part excluding open end and stab 12 of antenna element 60 and disposing branched meandrous element 61 in proximity to the outer periphery of antenna element 60.

By employing this configuration, the degree of freedom for tuning the impedance characteristic of antenna 62 can be enhanced owing to electromagnetic coupling between antenna element 60 and branched meandrous element 61 while being able to cope with a plurality of frequency bands.

Figure 18:
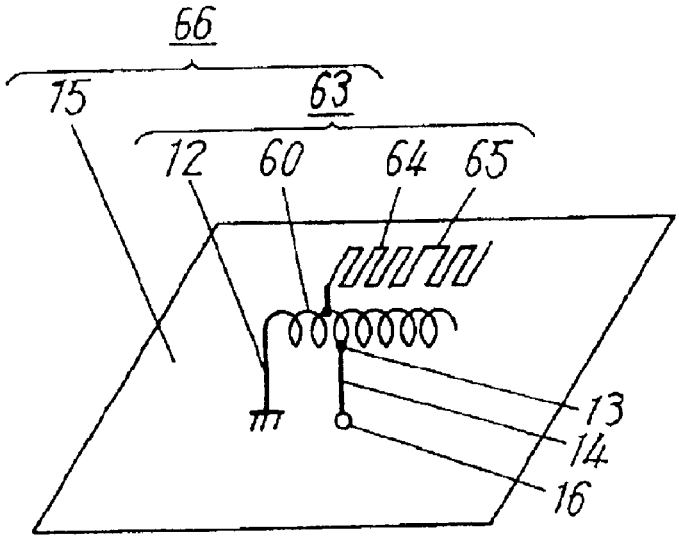
FIG. 18 is a diagram to illustrate an antenna configuration in Exemplary Embodiment 18 of the present invention.

Exemplary Embodiment 18:

FIG. 18 illustrates an antenna configuration in Exemplary Embodiment 18 of the present invention. In FIG. 18, antenna 66 is configured in the same way as in above-described Exemplary Embodiment 17 with the exception that antenna main section 63 is configured by forming straight section 65 as part of branched meandrous element 64 and disposing branched meandrous element 64 in proximity to the outer periphery of antenna element 60.

By employing this configuration, tuning of the impedance characteristic of antenna 66 can be made with ease in addition to the advantages of Exemplary Embodiment 17.

Figure 19:
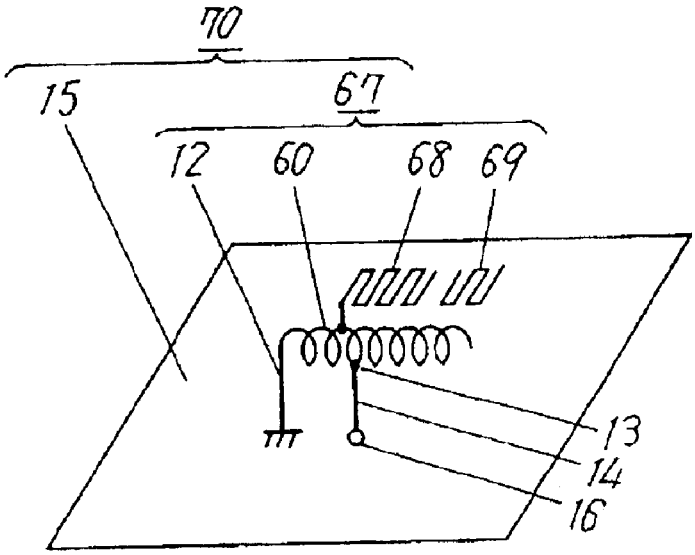
FIG. 19 is a diagram to illustrate an antenna configuration in Exemplary Embodiment 19 of the present invention.

Exemplary Embodiment 19:

FIG. 19 illustrates an antenna configuration in Exemplary Embodiment 19 of the present invention.

In FIG. 19, antenna 70 is configured in the same way as in Exemplary Embodiment 17 with the exception that antenna main section 67 is configured by disposing branched meandrous element 68 and parasitic meandrous element 69 in proximity to the outer periphery of antenna element 60.

By employing this configuration, tuning of the impedance characteristic of antenna 70 can be made with ease in addition to the advantages of Exemplary Embodiment 17.

Figure 20:
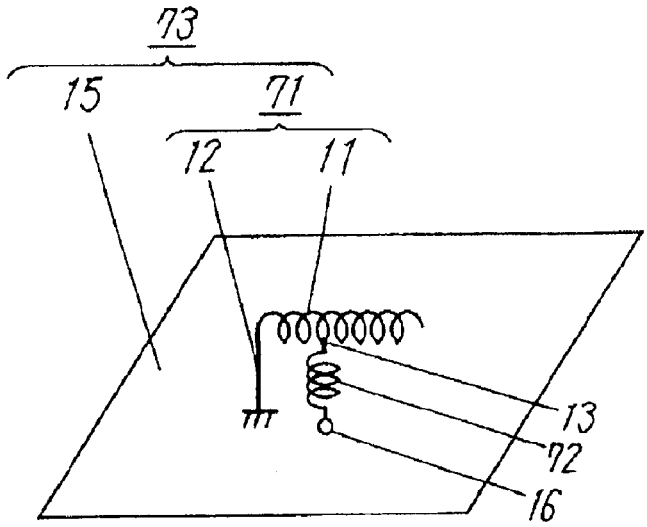
FIG. 20 is a diagram to illustrate an antenna configuration in Exemplary Embodiment 20 of the present invention.

Exemplary Embodiment 20:

FIG. 20 illustrates an antenna configuration in Exemplary Embodiment 20 of the present invention.

In FIG. 20, antenna 73 is configured in the same way as in Exemplary Embodiment 1 with the exception that antenna main section 71 is configured by forming spiral feeder line 72 at feeding point 13 of antenna element 11.

By employing this configuration, the reactance component of feeder line 72 of antenna main section 71 can be freely loaded and, as a result, the degree of freedom for tuning the impedance of antenna 73 can be enhanced. Also, as the polarization of the radiated waves from antenna element 11 and spiral feeder line 72 are in orthogonal directions, average effective antenna gain during actual use can be improved.

Figure 21:
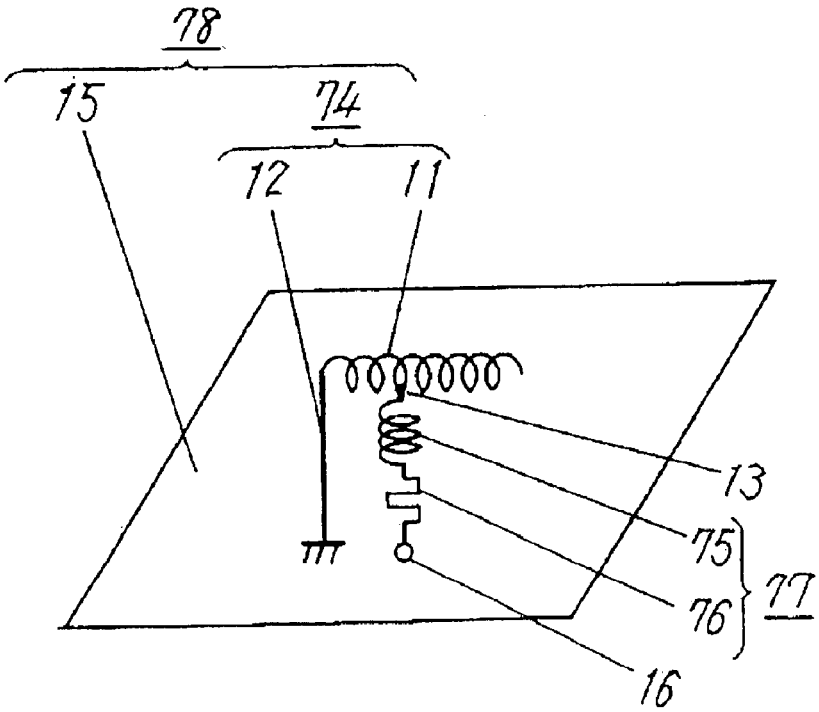
FIG. 21 is a diagram to illustrate an antenna configuration in Exemplary Embodiment 21 of the present invention.

Exemplary Embodiment 21:

FIG. 21 illustrates an antenna configuration in Exemplary Embodiment 21 of the present invention. In FIG. 21, antenna 78 is configured in the same way as in Exemplary Embodiment 20 with the exception that antenna main section 74 is configured by electrically connecting one end of spiral element section 75 to feeding point 13 of antenna element 11 and electrically connecting meandrous element section 76 to the other end thereby forming feeder line 77.

By employing this configuration, it becomes possible to freely load reactance component of feeder line 77 of antenna main section 74 thereby enabling easier fine tuning of the impedance characteristic of antenna 78 than in Exemplary Embodiment 20. Also, as the polarization of the radiated waves from antenna element 11 and feeder line 77 are in orthogonal directions, average effective antenna gain during actual use can be improved.

Figure 22:
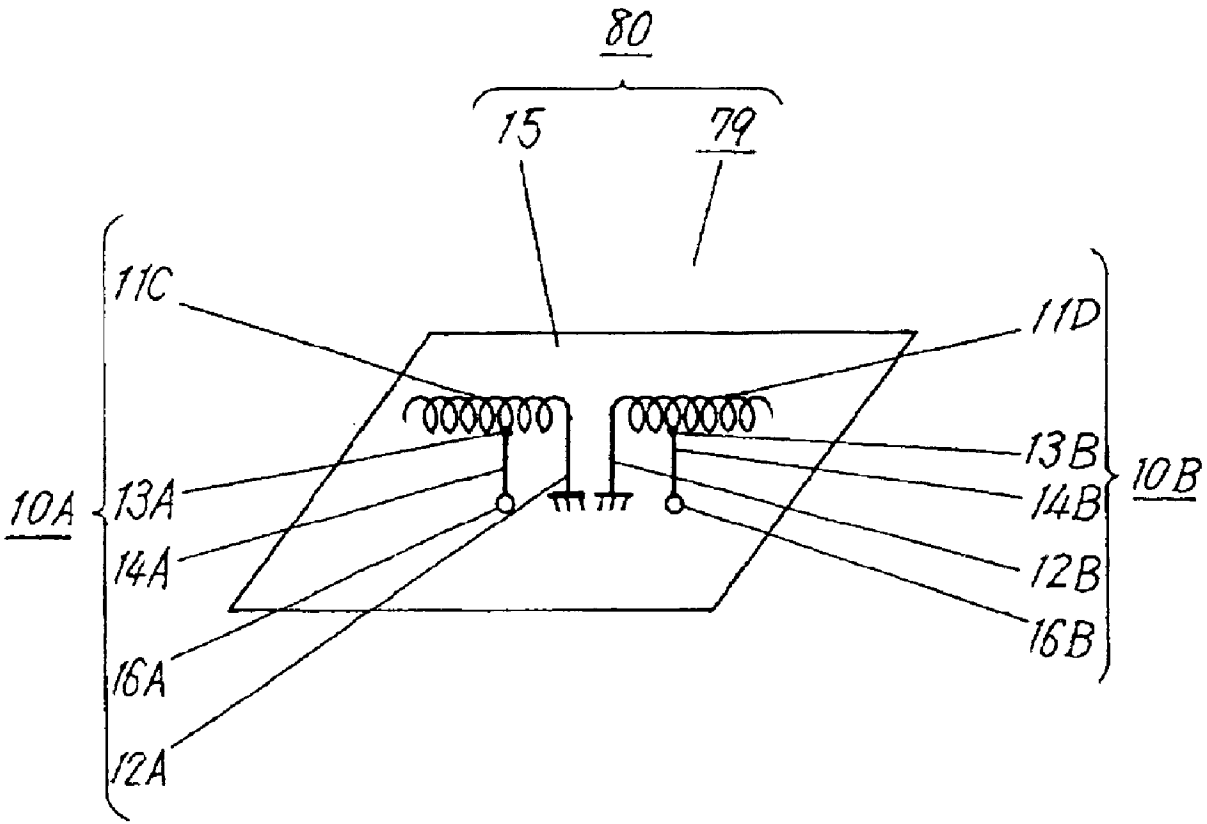
FIG. 22 is a diagram to illustrate an antenna configuration in Exemplary Embodiment 22 of the present invention.

Exemplary Embodiment 22:

FIG. 22 illustrates an antenna configuration in Exemplary Embodiment 22 of the present invention. In FIG. 22, first antenna main section 10A includes spiral antenna element 11C having an electric length that would provide an excellent impedance characteristic in a desired frequency band. One end of spiral antenna element 11C is open and the other end is connected to stub 12A formed vertically downward. Furthermore, feeder line 14A is connected to feeding point 13A. Also, antenna main section 79 is configured by forming second antenna main section 10B in a manner symmetric with first antenna main section 10A with respect to a plane. Furthermore, grounding conductor plate 15 is disposed in parallel with the axes of antenna elements 11C and 11D with a predetermined spacing in between. Feeder lines 14A and 14B pass through holes 16A and 16B formed on grounding conductor plate 15 without contacting.

Antenna 80 is configured in a manner described above. Such antenna 80 as configured with a pair of 10A and 10B provides a half-wavelength antenna equivalent to a dipole antenna.

A description of the operation of antenna 80 as configured above will now be given in the following.

A signal power in a desired frequency band as received by first and second antenna main sections 10A and 10B are input to a radio frequency circuit via feeder lines 14A and 14B and a balanced-unbalanced conversion circuit (not shown in FIG. 22) of a wireless device. On the other hand, when transmitting, a signal power from the radio frequency circuit of the wireless device is radiated from first and second antenna main sections 10A and 10B to the free space after conversely passing through balanced-unbalanced conversion circuit and feeder lines 14A and 14B. At this point, it is obvious that the radiation pattern for this antenna is equivalent to that of a dipole antenna. Also, the impedance characteristics of first and second antenna main sections 10A and 10B can be tuned in the same way as in Exemplary Embodiment 1.

By employing this configuration, tuning of the impedance characteristics of antenna 80 is enabled with ease without using an impedance matching circuit. Furthermore, as first and second antenna main sections 10A and 10B are fed in opposite phase, the characteristics can be regarded to be equivalent to those of a dipole antenna. Accordingly, when antenna 80 is installed in a wireless device, it is possible to reduce the radio frequency current flowing in the case of the wireless device and to reduce the effect of human body on communication characteristics of the wireless device while the device is in use.

In this exemplary embodiment, although an antenna as described in Exemplary Embodiment 1 is used, similar advantages and superior characteristics described in each exemplary embodiment can be obtained by using the respective antenna of Exemplary Embodiments 2 to 21.

Figure 23:
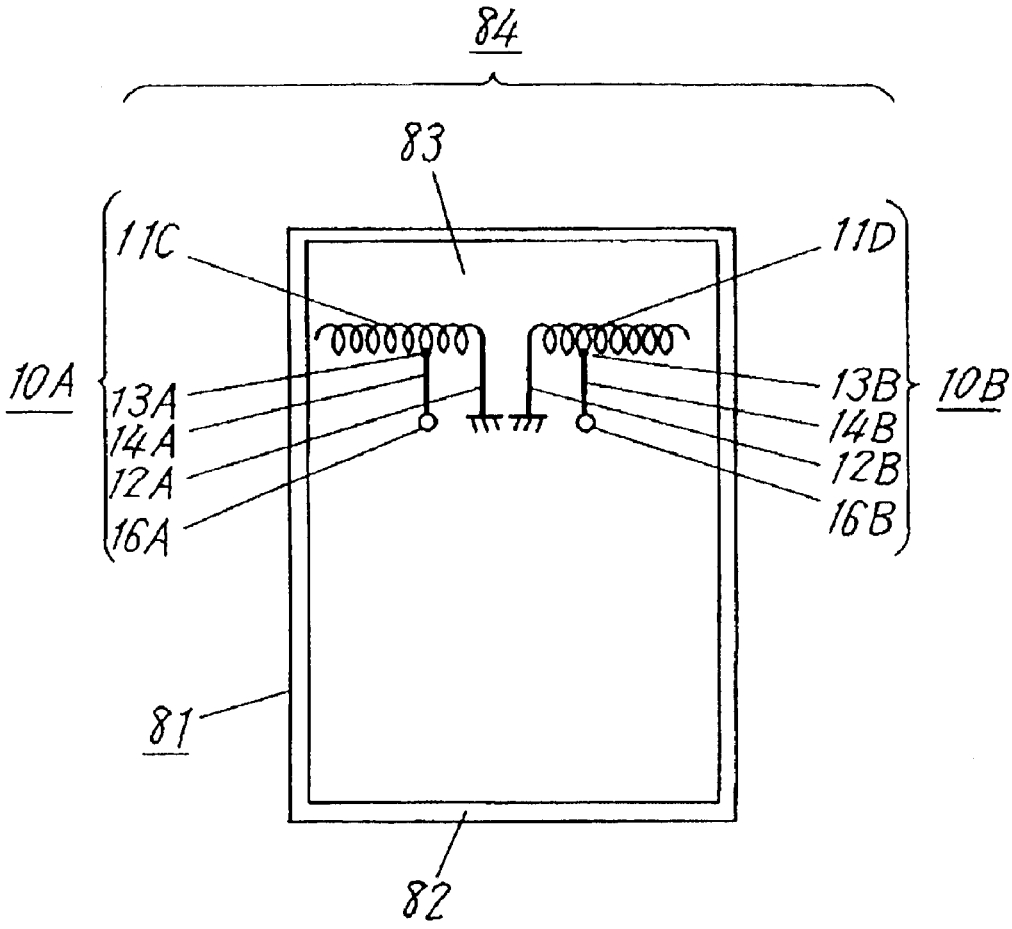
FIG. 23 is a diagram to illustrate a configuration of an antenna in Exemplary Embodiment 23 of the present invention and a portable telephone using the antenna.

Exemplary Embodiment 23:

FIG. 23 illustrates a configuration of a portable telephone that employs the antenna in Exemplary Embodiment 23 of the present invention. As illustrated in FIG. 23, the top surface of case 82 of portable telephone 81 is planar, first and second antenna main sections 10A and 10B of the Exemplary Embodiment 22 are disposed in case 82 in parallel with the top surface, and antenna 84 is configured utilizing grounding section 83 of case 82 of portable telephone 81 as an antenna grounding conductor plate. The other configuration is the same as that of Exemplary Embodiment 22.

By employing this configuration, as the grounding conductor for antenna 84 is configured with grounding section 83 of case 82 of portable telephone 81, the degree of freedom for laying out antenna 84 into portable telephone 81 is enhanced in addition to the advantages of Exemplary Embodiment 22. Also, case 82 can protect antenna 84 from mechanical shocks thus lengthening life of antenna 84, and the degree of freedom for cosmetic design of the main body of portable telephone 81 can be enhanced. Furthermore, as no impedance matching circuit is required, the price of portable telephone 81 can be lowered.

Figure 24:
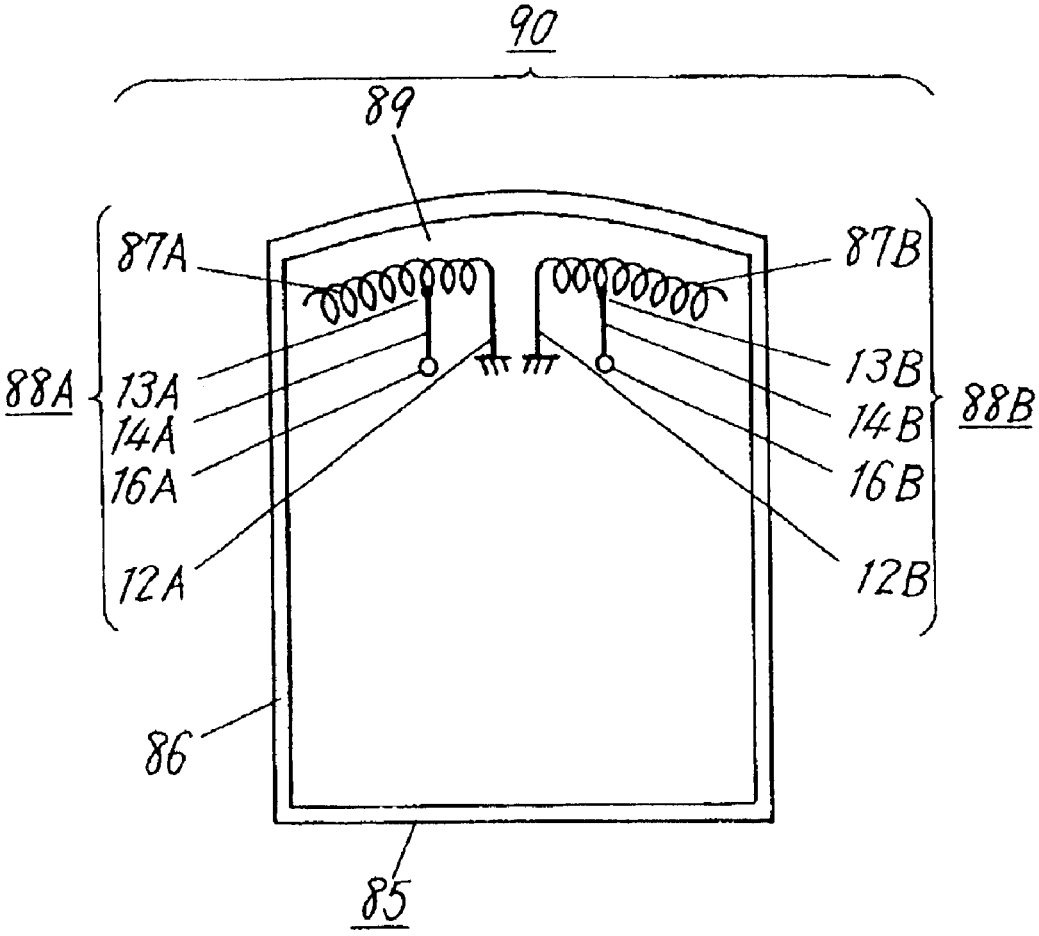
FIG. 24 is a diagram to illustrate a configuration of an antenna in Exemplary Embodiment 24 of the present invention and a portable telephone using the antenna.

Exemplary Embodiment 24:

FIG. 24 illustrates configurations of an antenna in the Exemplary Embodiment 24 of the present invention and of a portable telephone using the antenna. In FIG. 24, the top surface of case 86 of portable telephone 85 is shaped like an arch. The configuration is the same as in Exemplary Embodiment 23 with the exception that antenna elements 87A and 87B are disposed inside case 86 along the arched top surface.

By employing this configuration, by disposing first and second antenna main sections 88A and 88B inside case 86 of portable telephone 85 along the arch-shaped top surface, the space in portable telephone 85 can be effectively used thus achieving space saving in addition to the advantages of the Exemplary Embodiment 23.

Figure 25:
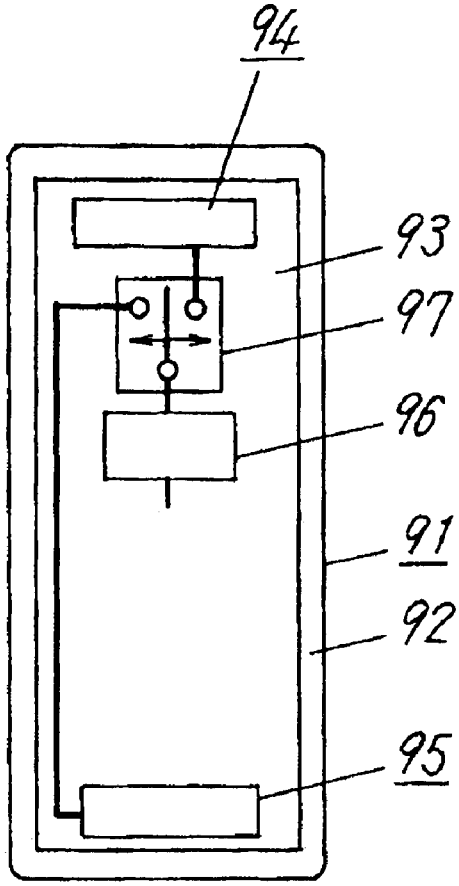
FIG. 25 is a diagram to illustrate a configuration of an antenna in Exemplary Embodiment 25 of the present invention and a portable telephone using the antenna.

Exemplary Embodiment 25:

FIG. 25 illustrates configurations of an antenna in Exemplary Embodiment 25 of the present invention and a portable telephone using the antenna. In FIG. 25, one antenna 94 as described in either one of Exemplary Embodiments 21 and 22 is disposed on the top end of circuit board 93 in case 92 of portable telephone 91, and another antenna 95 as described in either one of the Exemplary Embodiments 21 and 22 is disposed on the bottom end. The levels of power received by antenna 94 and 95 are compared, and the antenna with a higher power-level is connected with radio frequency circuit 96 by using automatic controlled switch 97. Thus, a diversity communication system is configured. Here, the method of installing antennas 94 and 95 is the same as in Exemplary Embodiment 23 or 24.

By employing this configuration, longer life can be achieved as case 92 of portable telephone 91 can protect antennas 94 and 95 against mechanical shocks and, at the same time, by using a diversity communications system, the effect due to human body during use of portable telephone 91 can be minimized and excellent quality of communication can be obtained. Furthermore, by disposing the above-mentioned two antennas 94 and 95 in a positional relationship in which they mutually intersect at right angles, improvement of the function of diversity communication can also be attained.

Furthermore, the degree of freedom for cosmetic design of the main body of portable telephone 91 can be enhanced by incorporation of the antenna, and the price of portable telephone 91 can be lowered as no impedance matching circuit is required.

In Exemplary Embodiments 1 to 25, the spiral element section may be changed to a meandrous element section, and the meandrous element section may be changed to a spiral element section. Also, in configuring an antenna element, a combination of different shapes as mentioned above or a combination of the same shapes is acceptable.

INDUSTRIAL APPLICABILITY

According to the present invention, as has been described above, a small and thin antenna with high productivity antenna is provided without using an impedance matching circuit, which complies with wider bandwidth, higher sensitivity, and multi-band capability and which allows easy tuning of the input impedance. Also, by incorporating an antenna of the present invention in a wireless device, not only the antenna can be protected against mechanical shocks from outside, wider bandwidth, multiple bands, higher sensitivity, downsizing, and low-profiled design can also be enabled. Furthermore, as an impedance characteristic that corresponds to a desired frequency band can be obtained, no complicated impedance matching circuit is required in the radio frequency circuit of the wireless device thus also enabling price reduction of the wireless device.

What is claimed is:

1. An inverted-F antenna comprising:

a grounding conductor plate;

an antenna element including a generally spiral conductor and a generally meandrous conductor both of which are disposed apart from said grounding conductor plate and connected in series;

a stub for electrically connecting an end portion of said antenna element with said grounding conductor plate;

a feeder line for connecting a feeding point being at a predetermined distance from said end portion with an external circuit, and a support member formed of a dielectric material and secured on said grounding conductor plate for supporting said antenna element, wherein one of said generally meandrous conductor and said generally spiral conductor, which is connected to said feeder line, allows the impedance of said antenna element to be matched with said feeder line.

2. The inverted-F antenna of claim 1, wherein at least a part of said stub, said antenna element, and said feeder line is a straight conductor.

3. The inverted-F antenna of claim 1, wherein at least a part of said generally meandrous conductor includes a straight conductor other than said generally meandrous conductor and said straight conductor functions as said antenna element.

4. The inverted-F antenna of claim 1, wherein at least one parasitic antenna element is disposed in proximity to said antenna element.

5. The inverted-F antenna of claim 4, wherein at least a part of said parasitic antenna element is configured with a generally spiral conductor.

6. The inverted-F antenna of claim 4, wherein at least a part of said parasitic antenna element is configured with a generally meandrous conductor.

7. The inverted-F antenna of claim 4, wherein at least a part of said parasitic antenna element is configured with a straight conductor.

8. The inverted-F antenna of claim 1, wherein said antenna element is bent at a predetermined position on said antenna element.

9. The inverted-F antenna of claim 1, wherein a branched antenna element is provided on a portion other than an end portion of said antenna element.

10. The inverted-F antenna of claim 9, wherein at least a part of said branched antenna element is configured with a generally spiral or generally meandrous conductor.

11. An inverted-F antenna comprising:

a grounding conductor plate;

an antenna element including a generally spiral conductor and a generally meandrous conductor both of which are disposed apart from said grounding conductor plate and connected in series;

a stub for electrically connecting an end portion of said antenna element with said grounding conductor plate;

a feeder line for connecting a feeding point being at a predetermined distance from said end portion with an external circuit, and a support member formed of a dielectric material and secured on said grounding conductor plate for supporting said antenna element, wherein one of said generally meandrous conductor and said generally spiral conductor, which is connected to said feeder line, allows the impedance of said antenna element to be matched with said feeder line, and wherein at least a part of at least one of said stub and said feeder line connected to said antenna element is configured with a generally spiral or generally meandrous conductor.

12. An antenna comprising:

two inverted-F antennas each comprising:

a grounding conductor plate;

an antenna element including a generally spiral conductor and a generally meandrous conductor both of which are disposed apart from said grounding conductor plate and connected in series;

a stub for electrically connecting an end portion of said antenna element with said grounding conductor plate;

a feeder line for connecting a feeding point being at a predetermined distance from said end portion with an external circuit, and a support member formed of a dielectric material and secured on said grounding conductor plate for supporting said antenna element, wherein one of said generally meandrous conductor and said generally spiral conductor, which is connected to said feeder line, allows the impedance of said antenna element to be matched with said feeder line, and wherein said two inverted-F antennas are fed in opposite phase.

13. An inverted-F antenna comprising:

a grounding conductor plate;

an antenna element including a generally spiral conductor and a generally meandrous conductor both of which are disposed apart from said grounding conductor plate and connected in series;

a stub for electrically connecting an end portion of said antenna element with said grounding conductor plate;

a feeder line for connecting a feeding point being at a predetermined distance from said end portion with an external circuit, and a support member formed of a dielectric material and secured on said grounding conductor plate for supporting said antenna element, wherein one of said generally meandrous conductor and said generally spiral conductor, which is connected to said feeder line, allows the impedance of said antenna element to be matched with said feeder line, and wherein said grounding conductor plate is shared with a grounding metal body of a wireless device.

14. A wireless device comprising:

an inverted-F antenna comprising:

a grounding conductor plate;

an antenna element including, a generally spiral conductor and a generally meandrous conductor both of which are disposed apart from said grounding conductor plate and connected in series;

a stub for electrically connecting an end portion of said antenna element with said grounding conductor plate;

a feeder line for connecting a feeding point being at a predetermined distance from said end portion with an external circuit, and a support member formed of a dielectric material and secured on said grounding conductor plate for supporting said antenna element, wherein one of said generally meandrous conductor and said generally spiral conductor, which is connected to said feeder line, allows the impedance of said antenna element to be matched with said feeder line, wherein a grounding conductor plate or grounding section of said wireless device is electrically connected with said stub, and said feeder line is electrically connected with a radio frequency circuit of said wireless device.

15. A wireless device comprising:

two inverted-F antennas for diversity communication, each of said inverted-F antenna comprising:

a grounding conductor plate;

an antenna element including a generally spiral conductor and a generally meandrous conductor both of which are disposed apart from said grounding conductor plate and connected in series;

a stub for electrically connecting an end portion of said antenna element with said grounding conductor plate;

a feeder line for connecting a feeding point being at a predetermined distance from said end portion with an external circuit, and a support member formed of a dielectric material and secured on said grounding conductor plate for supporting said antenna element, wherein one of said generally meandrous conductor and said generally spiral conductor, which is connected to said feeder line, allows the impedance of said antenna element to be matched with said feeder line, wherein a grounding conductor plate or grounding section of said wireless device is electrically connected with said stub, and said feeder line is electrically connected with a radio frequency circuit of said wireless device.

16. An inverted-F antenna comprising:

a grounding conductor plate;

an antenna element disposed apart from said grounding conductor plate, at least a part of said antenna element comprising a generally spiral conductor the center axis of which is substantially in parallel to said grounding conductor plate wherein the antenna element is disposed in the vicinity of a central portion of the grounding conductor plate;

a stub for electrically connecting an end portion of said antenna element with said grounding conductor plate;

a feeder line for connecting a feeding point on said antenna element at a predetermined distance from said end portion with an external circuit;

a parasitic antenna element disposed in proximity to or in a manner overlapping said antenna element, wherein said antenna element is secured on said grounding conductor plate with a support member formed of a dielectric material.

17. The inverted-F antenna of claim 16, wherein at least a part of said parasitic antenna element is configured with a generally spiral conductor.

18. The inverted-F antenna of claim 16, wherein at least a part of said parasitic antenna element is configured with a generally meandrous conductor.

19. The inverted-F antenna of claim 16, wherein at least a part of said parasitic antenna element is configured with a straight conductor.

20. An antenna comprising:

two inverted-F antennas, each comprising:

a grounding conductor plate;

an antenna element disposed apart from said grounding conductor plate, at least a part of said antenna element comprising at least one of a generally spiral conductor and a generally meandrous conductor;

a stub for electrically connecting an end portion of said antenna element with said grounding conductor plate; and a feeder line for connecting a feeding point on said antenna element at a predetermined distance from said end portion with an external circuit, wherein said antenna element is secured on said grounding conductor plate with a support member made of a dielectric material, and, wherein said two inverted-F antennas are fed in opposite phase.

21. The inverted-F antenna of claim 1, wherein the antenna element is disposed in the vicinity of a central portion of the grounding conductor plate.

* * * * *